US005226222A

United States Patent [19]

Hanaoka et al.

[11] Patent Number: 5,226,222

[45] Date of Patent: Jul. 13, 1993

[54] FABRICATION METHOD FOR TRANSFORMERS WITH AN AMORPHOUS CORE

[75] Inventors: Katsumi Hanaoka, Kobe; Masatake Hirai, Kyoto; Masatake Kokado, Ibaraki; Takeshi Uchikura, Osaka; Nobuyuki Sumida, Sakai; Syoichi Shii, Chitose; Koichi Akimoto, Takaishi; Tadanori Matsubayashi, Ibaraki; Toshio Fujiwara, Osaka; Yasuo Yamamoto, deceased, late of Settu; by Michiko Yamamoto, heiress, Settu; Masako Sakamoto, heiress, Minoh; Kyoko Kan, heiress, Takatsuki, all of Japan

[73] Assignee: Daihen Corporation, Japan

[21] Appl. No.: 742,355

[22] Filed: Aug. 8, 1991

[30] Foreign Application Priority Data

Aug. 8, 1990 [JP] Japan ..... 2-209629
Dec. 26, 1990 [JP] Japan ..... 2-406553

[51] Int. Cl.[5] ..... H01F 41/02

[52] U.S. Cl. ..... 29/606; 29/609; 336/234

[58] Field of Search ..... 29/609, 605, 606; 336/234

[56] References Cited

U.S. PATENT DOCUMENTS 4,648,929 3/1987 Siman ..... 29/609 X
4,789,849 12/1988 Ballard et al. .
4,893,400 1/1990 Chenoweth ..... 29/609 X

*Primary Examiner*—Carl E. Hall
*Attorney, Agent, or Firm*—Scully, Scott, Murphy & Presser

[57] ABSTRACT

A method for fabricating transformers each having a core made from a lamination body of strips made of an amorphous magnetic alloy comprises the steps of forming a ring-like lamination body using a grindstone cutter and a gas coolant to obtain a developed lamination body, shaping the developed lamination into a substantially rectangular core, assembling windings with the core using a sliding tool for inserting leg portions of the core into windows of windings, covering the core with a core cover and mounting a grounding member so as to ground the core to the ground.

6 Claims, 19 Drawing Sheets

FABRICATION METHOD FOR TRANSFORMERS WITH AN AMORPHOUS CORE

BACKGROUND OF THE INVENTION

1. Field of the Invention

The present invention relates to a method for fabricating transformers each comprising an amorphous core and a pair of windings.

2. Description of the Prior Art

Recently, amorphous magnetic alloys have become more important since they exhibit a small magnetic loss (See, for instance, U.S. Pat. No. 4,789,849) and, accordingly, their application to cores of transformers has been researched.

The most significant problem upon utilizing them as cores is that they are supplied only in the form of a thin strip or film and such an amorphous strip is hard to handle since it is easily deformed even by its weight and is apt to break by a small external force.

In other words, the amorphous core has an excellent magnetic property but is difficult to fabricate because of mechanical properties of the amorphous strip as a material.

SUMMARY OF THE INVENTION

As object of the present invention is to provide a fabrication method for transformers with a core made from a lamination body of strips made of an amorphous magnetic alloy which is able to form the lamination body easily.

Another object of the present invention is to provide a fabrication method for transformers which is able to shape the lamination body of amorphous strips into a core in a simple manner.

A further object of the present invention is to provide a fabrication method for transformers which is able to assemble windings with the core easily.

One more object of the present invention is to provide a fabrication method for transformers which is able to protect the core with a core cover.

In order to a achieve these object, according to the present invention, there is provided a fabrication method for transformers with an amorphous core comprising steps of (a) forming a ring-like lamination body by winding a thin strip of an amorphous magnetic alloy around a mandrel, (b) cutting said lamination body off in a radial direction using a grindstone cutter and a gas coolant to form a developed lamination body, (c) shaping said developed lamination body into a core of a substantially rectangular configuration by jointing cut ends of said lamination body, (d) magnetic-annealing said core, (e) inserting leg portions of said core into windows of windings after opening a joint section thereof and thereafter, jointing the opened joint section again, (f) covering said core with an insulation cover and (g) mounting a ground plate of a conductive material on said insulation cover to ground said core covered by said insulation cover to a ground.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
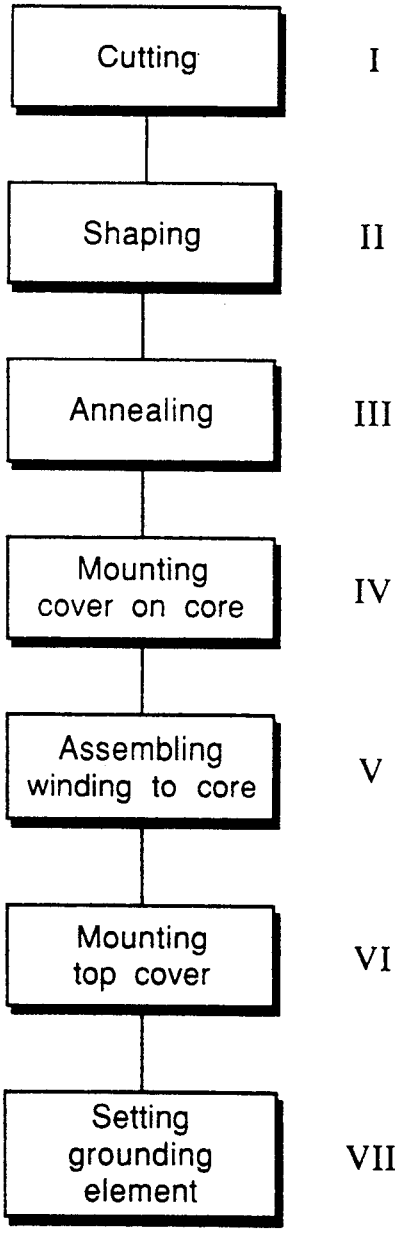
FIG. 1 is a chart for showing fabrication steps according to the present invention.

The fabrication method according the present invention is substantially comprised of steps from I to VII, as shown in FIG. 1.

Hereinafter, respective steps are explained in the order shown in FIG. 1.

I. Cutting process.

Figure 2:
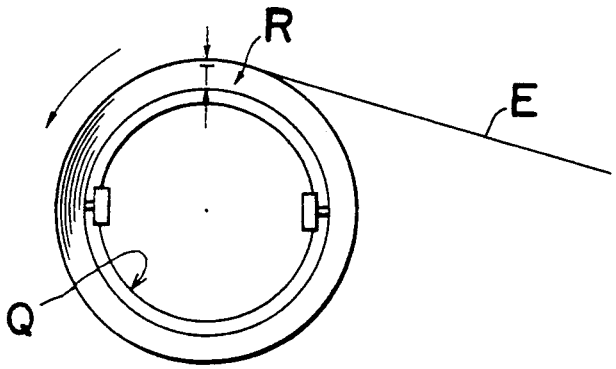
FIG. 2 is a front view for showing a winding operation of a strip of an amorphous magnetic alloy.

At first, a thin strip E made of an amorphous magnetic alloy is wound around a mandrel Q by driving the same to form a ring-like laminated body R having a predetermined thickness T, as shown in FIG. 2.

Figure 3:
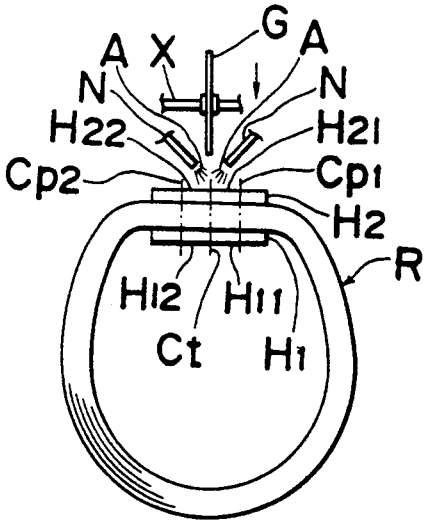
FIG. 3 is a front view for showing a cutting operation of a ring-like lamination body.

Thereafter, as shown in FIG. 3, a portion of the ring-like laminated body R is clamped at two positions $Cp_1$ and $Cp_2$ by C vices (not shown) after putting a pair of holding plates $H_1$ and $H_2$ on inner and outer peripheries thereof to cut off the ring-like laminated body R. Each of the clamping positions $Cp_1$ and $Cp_2$ is set at a center of the width of the ring-like laminated body R. The cutting operation is made using a disk grindstone G.

The grindstone G is moved at a center position Ct between two clamp positions $Cp_1$ and $Cp_2$ in a direction of the thickness of the ring-like laminated body R while rotating the same around an axis X. In order to cool a cut portion, there are provided a pair of air nozzle N directed to the cut portion to blow dry cooling air A thereon. Other coolant gases such as inert gases can be used instead of air. The employment of a dry coolant serves to simplify the cutting process since it becomes unnecessary to remove a liquid coolant.

In order to avoid sticking of the amorphous magnetic alloy material due to heat generated upon cutting, it is desirable to choose a variety of suitable specifications related to the grindstone cutter such as the grain size of the grindstone, a kind of binder which binds grains of the grindstone, the cutting speed, the cutting power and the like. For instance, it is desirable to choose a grain size larger than that in the case of use of a liquid coolant and a cutting speed faster than that in the case of a liquid coolant.

Further, it is desirable to restrict the thickness of the laminated body to be cut off at one time in order to avoid exposing the cut portion to a high temperature.

It is also advantageous in that a liquid is not used as a coolant which may cause rust between laminated strips during the cutting operation if such a liquid coolant is used.

Since it is inevitable that the cut surface of the ring-like laminated body R is roughened by drying cutting, it is desirable to divide the cut laminated body R into several units (herein after referred to as a unit lamination) and to joint each unit lamination at a position different from that of an adjacent unit lamination after shifting respective ends of the unit laminations stepwisely. As the joint method for the unit laminations shifted stepwisely, there have been used a known so called stepwise overlapping joint method and a stepwise abutting joint method. In this preferred embodiment, the stepwise overlapping joint method is mainly explained but the latter method is also briefly explained.

Figure 4:
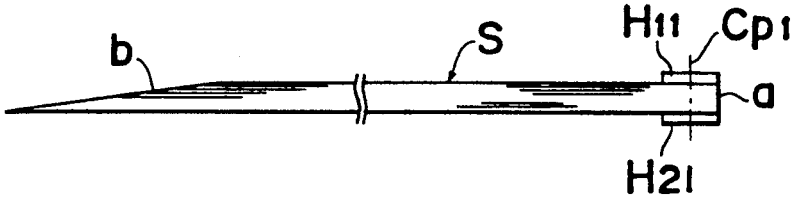
FIGS. 4, 5 and 6 are front views showing respectively steps for forming unit laminations from a cut lamination body.

By the cutting operation mentioned above, the holding plates H1 and H2 are also cut into halves H11, H 12, H21 and H22, respectively. The cut laminated body R is developed straight, as shown in FIG. 4, while maintaining the clamping state at one cut end, for instance, at the side of the cut halves H11 and H21 (hereinafter the cut and developed laminated body is referred to as a developed lamination body S). The developed lamination body S at this stage has a vertical end plane a at one end thereof and an inclined end plane b at the other end thereof. To this cut end plane a of the developed lamination body S, there is applied a suitable bonding agent such as a dilution of a bonding agent of solvent evaporation type. After applying the same to the cut end plane a thinly, the thin film applied is dried for several minutes.

Figure 5:
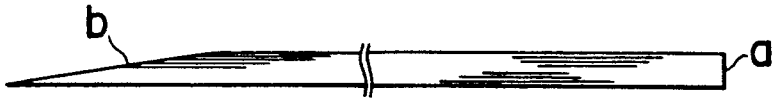

Thereafter the halves H11 and H21 are dismounted as shown in FIG. 5. The developed lamination body S can maintain its configuration as it is due to the holding force by the bonding film even after dismounting the halves H11 and H21. Next, the developed lamination body S is divided into a plurality of unit laminations U each of which has a predetermined thickness ranging from 0.3 to 1.0 mm. Each unit lamination is separated from the developed lamination body S by inserting a tool having a knife edge (not shown) at one end thereof between the laminated strips. The unit laminations thus obtained are indicated by U1, U2, U3, . . . , Un in the order of length from longer side, as shown in FIG. 5.

Thereafter, every predetermined number of unit laminations, for instance, every four unit laminations, for instance, U1 to U4, U5 to U8 and the like, are assembled into a lamination block. These lamination blocks are denoted by B1, B2 and the like.

Figure 6:
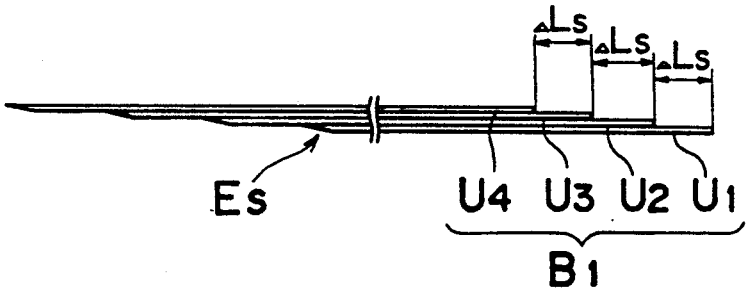

FIG. 6 shows a lamination block B1 consisted of four unit laminations U1 to U4.

Upon assembling four unit laminations, the first one U1 is laid on a level block (not shown) at first while maintaining the shortest strip Es thereof at the under side. Next, the second unit lamination U2 is stacked on the first one in the same manner as the first one after shifting the bonded end of the second one from that of the first one by a predetermined distance $\Delta Ls$ in the length-wise direction of the unit lamination. The third and fourth unit laminations U3 and U4 are respectively stacked in the same manner as mentioned above to form the lamination block B1 finally. Other lamination blocks B2, B3 and so on are formed in the same manner mentioned above.

II. Shaping process

II-1. First shaping method

After forming a plurality of lamination blocks, they are wound around a circular winding bobbin to form a circular core. The winding bobbin has an outer periphery having a length equal to that of the inner periphery of the shortest lamination block. This shortest lamination block is wound around the winding bobbin from the bonded end as a winding start end so as to overlap the bonded end by the other end thereof. In such a manner as mentioned above, other laminations blocks are wound around the winding bobbin jointing each other by the stepwise overlapping method.

Figure 7:
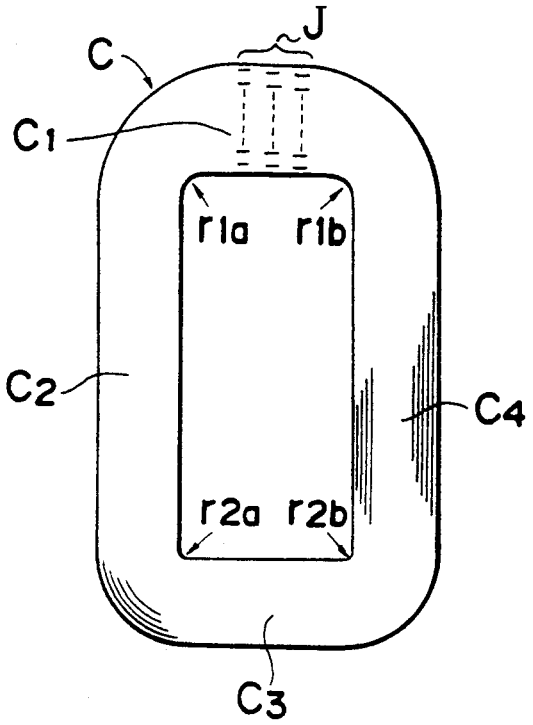
FIG. 7 is a front view of a core formed according to the present invention.

The circular core thus formed is deformed into a rectangular shape as shown in FIG. 7. This rectangular core C is comprised of two yoke portions C1 and C3 and two leg portions C2 and C4 and, in yoke portion C1, there is formed an overlapping joint portion J.

Upon shaping the core, it is desirable to make curvature radii r1*a* and r1 *b* of the inner corners of the core C at the side of the first yoke C1 having the joint portion J larger than those r2*a* and r2*b* at the side of the second yoke C3, as shown in FIG. 7.

This structure is advantageous in that stresses at the inner corners of the first yoke portion C1 which might be caused upon opening the joint section can be minimized. If the stresses are large, the magnetization property of the core is deteriorated thereby.

It is also advantageous to make the whole of the first yoke C1 round to yield a large curvature radius.

Figure 8:
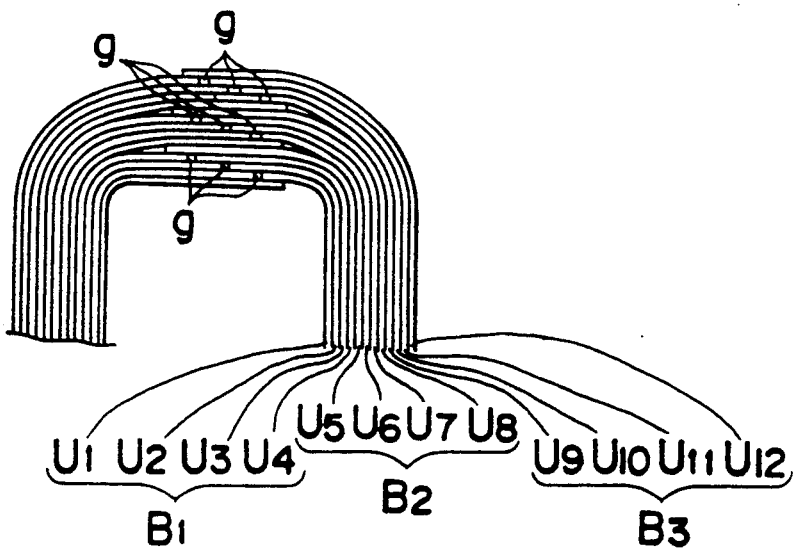
FIG. 8 is a partial front view of a yoke of the core for showing a joint method according to the present invention.

FIG. 8 shows the overlapping joint portion J and, in the example shown, the core C is comprised of three lamination blocks B1 to B3. Each unit lamination is wound in such a manner that both ends thereof overlap with each other and the bonded end thereof has a gap g to the other end of the inner unit lamination. In this winding structure of the core C, a magnetic flux generated in one unit lamination flows therethrough and circulates via the overlapped portion of both ends. In other words, the magnetic flux never flows into the adjacent unit lamination via the gap g. Accordingly, even when the cut planes are roughened upon cutting by the grindstone, the roughness thereof never affects the magnetization property of the core.

Figure 9:
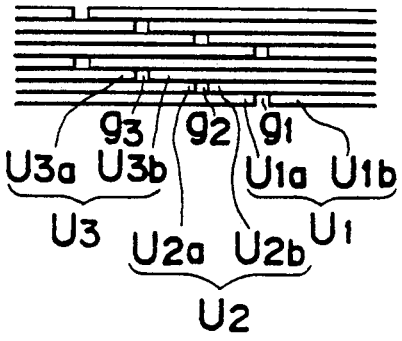
FIG. 9 is a partial front view of a yoke of the core for showing another jointing method.

FIG. 9 shows a part of a joint formed according to the stepwise abutting joint method.

In this case, a part of a magnetic flux generated in one unit lamination, for instance the second lamination U2 flows from the one end U2*a* to the other end U2*b* through the gap g2 and the rest thereof flows from the one end U2*a* to the other end U2*b* by following via the adjacent unit laminations U1 and U3, respectively. Since the magnetic resistance of the gap g2 becomes large if the end plane is roughened by the dry cutting, the densities of the magnetic flux of the unit laminations U1 and U3 in the vicinity of the gap g2 become large and, thereby, the magnetization property of the core is affected.

However, according to results of our experiment related to the structure obtained according to the abutting joint method, it is confirmed that the rate of increase in the no load loss is not so large although the rate of increase in the magnetizing current is large in the case where the cut plane is roughened.

II-2. Second shaping method

Figure 10:
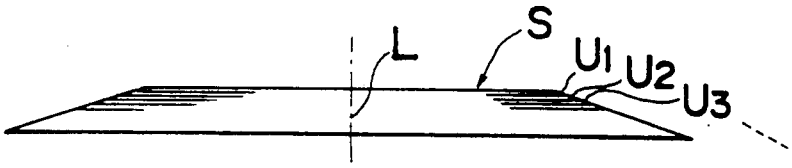
FIG. 10 is a front view of a lamination body having a symmetric lamination structure according to another shaping method according to the present invention.

At first, a ring-like laminated body after being cut is developed symmetrically with respect to a center line L in a length-wise direction thereof, as shown in FIG. 10.

The developed lamination body S thus formed is divided into unit laminations U1, U2, U3 and so on each of which has a predetermined thickness ranging from 0.5 to 1.0 mm.

Figure 11:
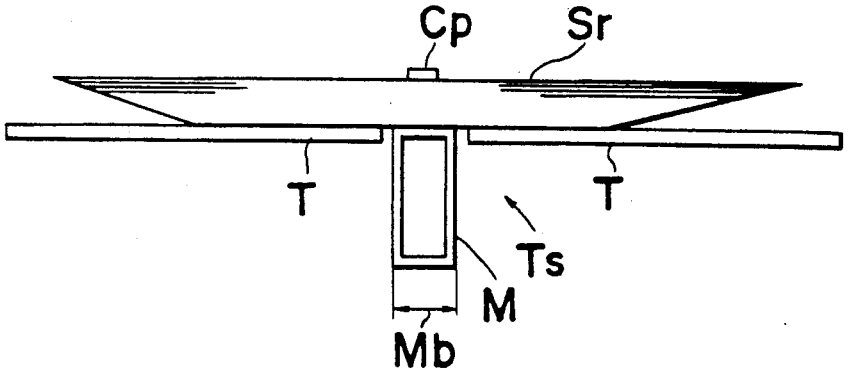
FIG. 11 is a front view of a shaping apparatus for shaping a lamination body according to another shaping method.

Thereafter, the developed lamination body S is rearranged to form a rearranged lamination body Sr using a stacking table Ts formed by a pair of flat tables T and a rectangular shaping mandrel M arranged therebetween, as shown in FIG. 11.

Figure 12:
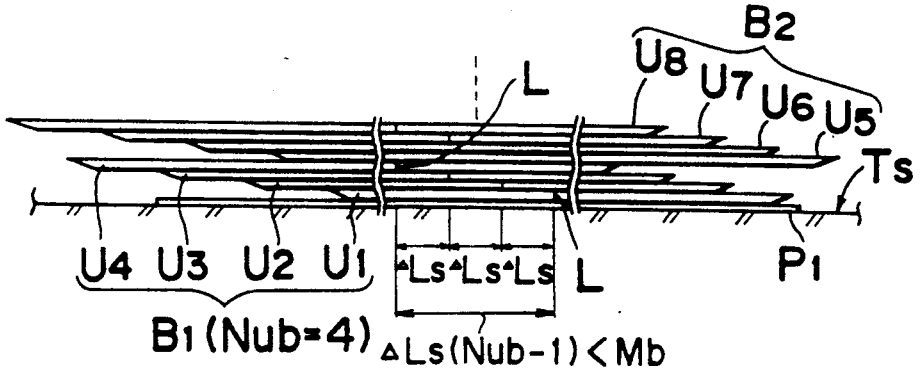
FIG. 12 is a partial front view of the lamination body shown in FIG. 11 for showing a lamination structure thereof according to the present invention.

A manner of formation of the rearranged lamination body Sr is as follows;

At first, an inner protection sheet P1 for protecting the inner periphery of the core is put on the stacking table Ts, as shown in FIG. 12. The inner protection sheet P1 is set for the center thereof to coincide with the center of the short side of the shaping mandrel M.

Next, the first unit lamination U1 is piled on the inner protection sheet P1 so as for the center position L thereof to coincide with one end of the short side of the shaping mandrel M. Then, the second unit lamination U2 is piled on the first one U1 in a state that the center position L of the second one is shifted from that of the first one by a distance ΔLs ranging from several $mm_s$ to ten and several $mm_s$. This shift distance ΔLs is essentially dependent on the thickness of the unit lamination and the minimum value thereof should be several times as large as the thickness of the unit laminations.

Further, the third and fourth unit laminations U3 and U4 are stacked successively in the same manner as stated above. In the present preferred embodiment, one lamination block, for instance a first block B1, is formed by four unit laminations, for instance the first to fourth unit laminations U1 to U4. The next (second) lamination block B2 is also formed on the first block B1 in the same manner as mentioned above. By repeating the stacking process of the lamination block, the rearranged lamination body Sr is formed finally, as shown schematically in FIG. 10.

As stated above, the unit laminations belonging to the same lamination block are stacked shifted in the same direction by the distance ΔLs with respect to each other. Assuming that the number of unit laminations included in a lamination block is Nub, the center position L of the outer most unit lamination of the lamination block is shifted from that of the inner most one by ΔLs (Nub-1). Each of several lamination blocks arranged on the inner side of the core should be limited within the length mb of the short side of the shaping mandrel but, with respect to the lamination blocks arranged on the outer side, it is not necessarily limited therewithin and, accordingly, it can be increased gradually as the position of the lamination block proceeds to the outer side. Thus, the number Nub of unit laminations belonging to one lamination block can be increased as the total shift amount is increased. However, in the present preferred embodiment, Nub is kept constant.

When all lamination blocks have been stacked, an outer protection sheet p2 (not shown in FIG. 12) is put on the outer most lamination block.

As shown in FIG. 11, the rearranged lamination body Sr mounted on the mounting table Ts is clamped between a clamp plate Cp and the shaping mandrel at the center thereof using a suitable clamping means such as a C vice (not shown).

Thereafter, the support of the rearranged lamination body Sr by the pair of flat tables T is released by descending them using a suitable lifting and descending mechanism such as a hydrodynamic cylinder.

Figure 13:
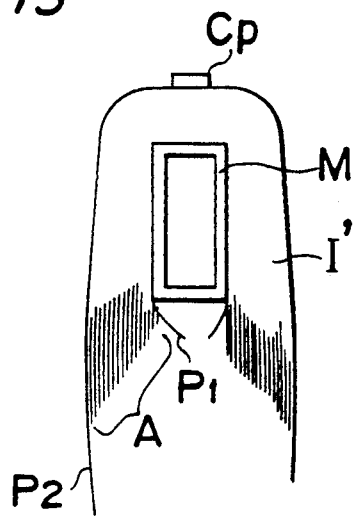
FIG. 13, 14 and 15 are front views for showing shaping steps of the lamination body shown in FIG. 11, respectively.

As shown in FIG. 13, when the support by the pair of flat tables T is removed, both wing portions of the rearranged lamination body Sr naturally sag down by their dead-weights and, accordingly, a core I' of inversed U shape opened downwardly is formed.

Figure 14:
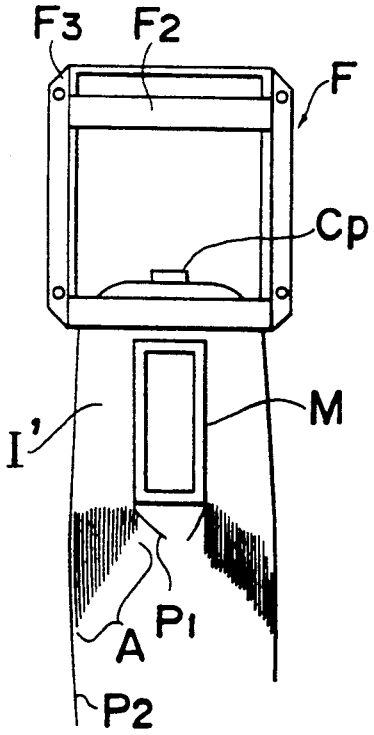
Figure 15:
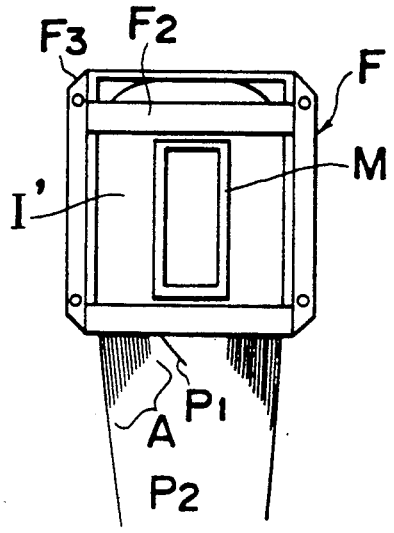

Next, a shaping frame F is set to the core I' by descending it downwardly, as shown in FIG. 14 and FIG. 15.

Figure 16:
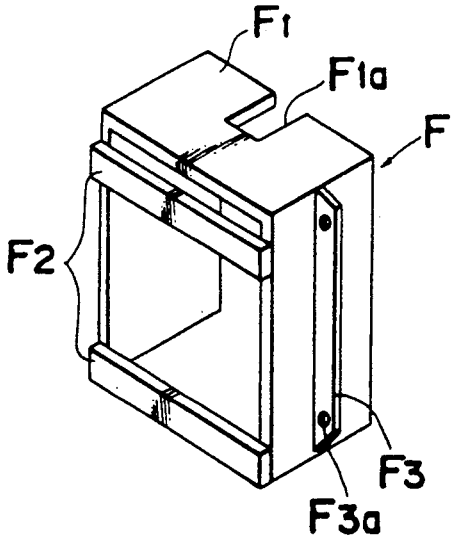
FIG. 16 is a perspective view of a shaping frame used for shaping the lamination body into a core according to the present invention.

FIG. 16 shows a structure of the shaping frame F which is comprised of a main frame F1 of ⊓ shape, a pair of supporting arms F2 connecting upper and lower portions of leg portions of the main frame F1 at one side thereof and a pair of reinforcement plates F3.

A rectangular aperture F1*a* is perforated on the ceiling portion of the main frame F1 to accept the clamping plate Cp and small circular apertures F3*a* are provided on each reinforcement plate F3 for hanging the frame F by hooks to convey the same. Thus, the core I' is held by the shaping frame F and the shaping mandrel M. At this stage or later, the clamping is released.

Figure 17:
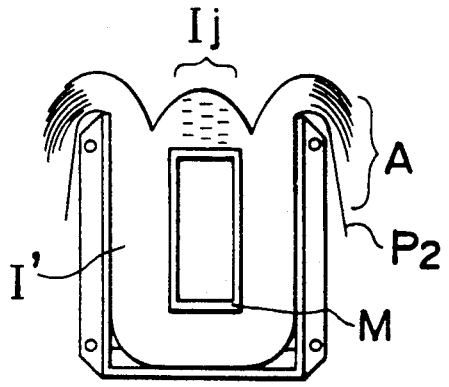
FIG. 17 and 18 are front views showing a jointing process of the lamination body, respectively.
Figure 18:
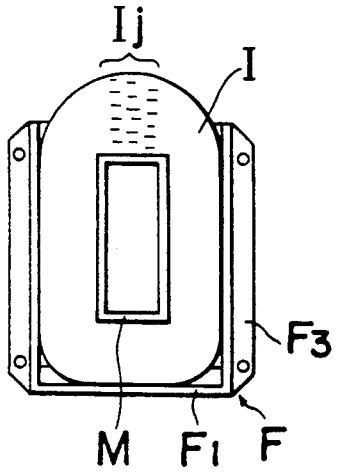

Thereafter, the shaping frame F wherein the core I' is inserted is reversed by rotating the shaping mandrel M, as shown in FIG. 17. Then, the opened section of the core I' is closed by jointing each unit lamination from inside to outside to form a joint Ij, as shown in FIG. 18. After the closing or jointing operation in finished, the outer protection sheet P2 is closed by overlapping the both ends thereof.

III. Annealing process

After shaping the core, it is subjected to a magnetic annealing treatment. The magnetic annealing itself is well known to those skilled in the art and, accordingly, further explanation thereabout is omitted.

IV. Cover mounting onto the core

Since the amorphous strip forming the core is easily deformed and quite brittle, it is desirable to cover the core with a cover in order to protect the core.

Figure 19:
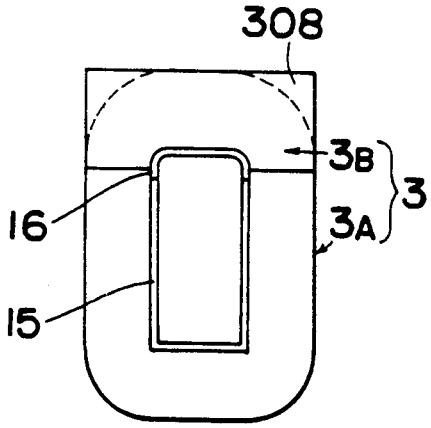
FIG. 19 is a front view of a core covered by a core cover.

FIG. 19 shows a core completely covered by a core cover 3 made from an insulation paper such as craft paper.

The core cover 3 is comprised of a first cover 3A which covers two leg portion and the bottom yoke of the core and a second cover 3B which covers top yoke thereof.

Figure 20:
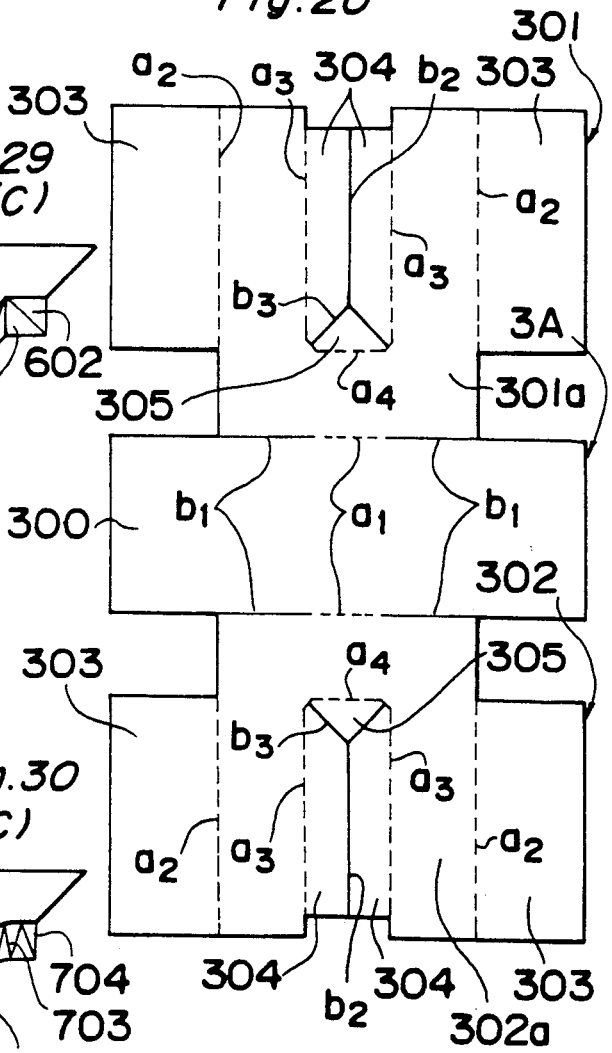
FIG. 20 is a developed plan view of a first cover 3A of the core cover shown in FIG. 19.

FIG. 20 is a developed plan view of the first cover 3A wherein dot lines denote folding lines and real lines denote cut lines.

As shown therein, the first cover 3A has a center portion 300 for covering the outer periphery of the bottom yoke of the core and a pair of side portions 301 and 302 for covering the two leg portions of the core which are folded along cut lines b1, and folding lines a1 at right angle from the center portion, respectively. Each side portion 301 or 302 has a main portion 301*a* or 302*a* of U-shape for covering a side surface of the core except for the side surface of the top yoke thereof, a pair of wing portions 303 to be folded along the folding line a2 for covering outer peripheries of two leg portions thereof, a pair of inner portions 304 separated by cut lines b2 and b3 and folded along folding lines a3 for covering the inner peripheries of the leg portions of the core and a triangular portion 305 to be folded along a folding line a3 for covering the inner periphery of the bottom yoke thereof.

Figure 21:
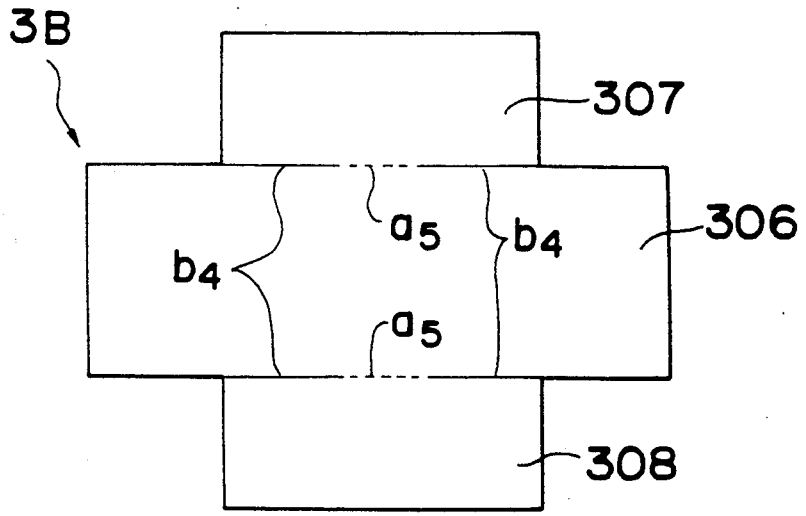
FIG. 21 is a developed plan view of a second cover 3B of the core cover shown in FIG. 19, FIGS. 22, 23 and 24 are perspective views showing partial covers for covering predetermined portions of the core, respectively.

FIG. 21 is a developed plan view of the second cover 3B which is comprised of a center portion 306 for covering the outer periphery of the top yoke of the core and a pair of side portions 307 and 308 which are folded along folding lines a5 and cut lines b4 to cover side planes of the top yoke.

The core cover 3 further provides a variety of partial covers 4, 5, 6, 7, 8 and 9 shown in FIGS. 22 to 26, respectively.

Figure 27:
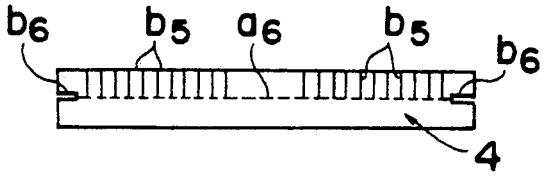
FIGS. 27, 28, 29, 30 and 31 are views showing respective compositions of partial covers shown in FIGS. 22, 23, 24, 25 and 26, respectively.
Figure 22:
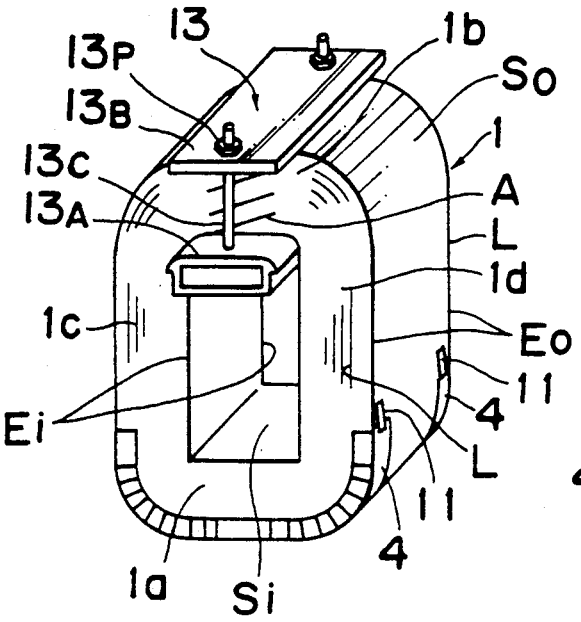

The partial cover 4 shown in FIG. 22 is a cover for covering the edge of the bottom yoke 1*a* of the core 1. FIG. 27 shows a developed plan view thereof wherein a6 denotes a folding line and b5 and b6 denote cut lines, respectively.

Figure 28:
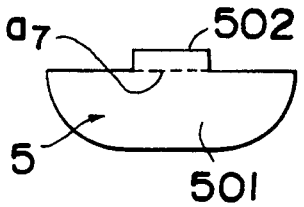
Figure 23:
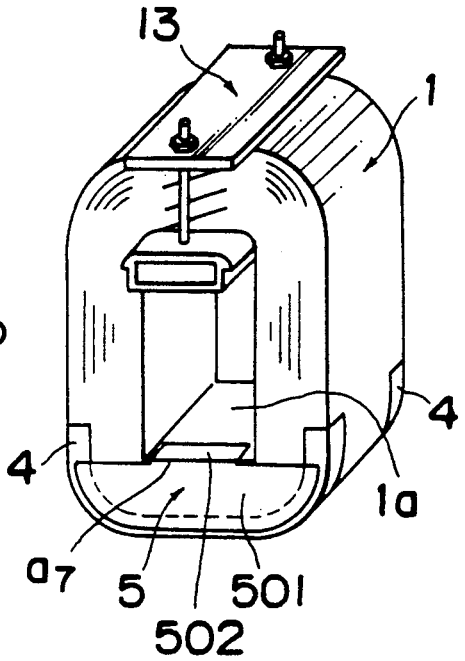

The partial cover 5 shown in FIG. 23 is an inner cover for covering the side plane of the bottom yoke 1*a* which is comprised of a main part 501 for covering the side plate mentioned above and a part 502 folded along a folding line a7, as shown in FIG. 28 showing a developed plan view of the cover 5.

Figure 29A:
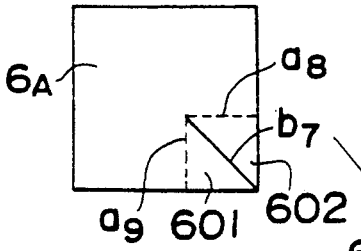
Figure 29:
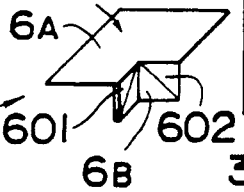
Figure 29:
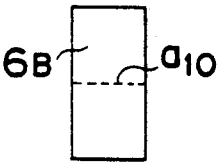
Figure 24:
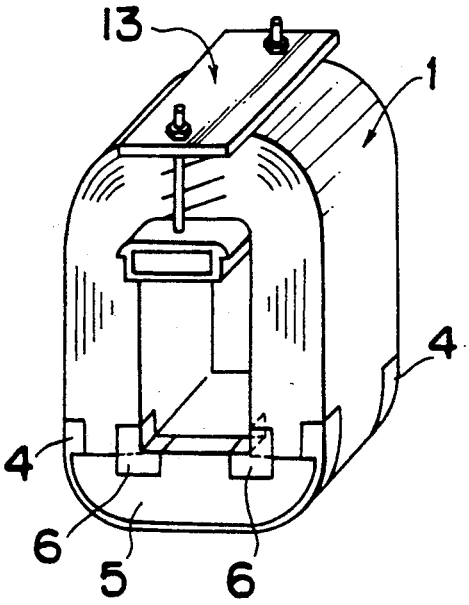

The partial cover 6 shown in FIG. 24 is a cover for covering each inner corner of the bottom yoke of the core and is comprised of a square part 6A and an elongated rectangular part 6B as shown in (A) and (B) of FIG. 29. The square part 6A has a pair of small triangular portions 601 and 602 at one corner thereof which are separated by a cut line b7 and folded along folding lines a8 and a9, respectively. The rectangular part 6B has a center folding line a10. These parts 6A and 6B are assembled in a manner shown in (C) of FIG. 29 to form one inner corner cover 6.

Figure 25:
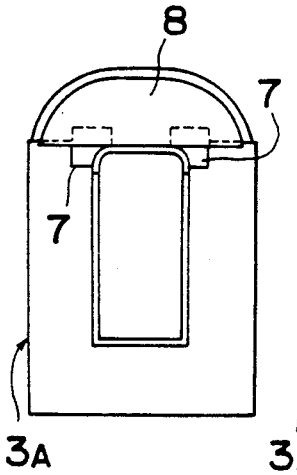
FIGS. 25 and 26 are front views showing other partial covers, respectively.
Figure 30A:
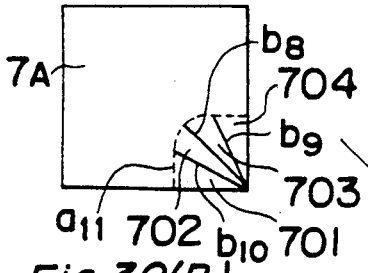
Figure 30:
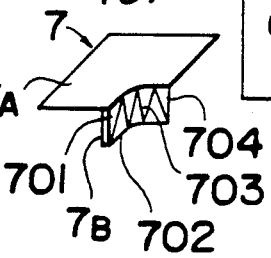
Figure 30B:
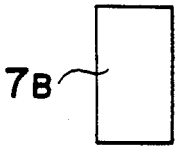

The partial cover 7 shown in FIG. 25 is a cover for covering each inner corner of the top yoke of the core and is comprised of a square part 7A and an elongated rectangular part 7B as shown in (A) and (B) of FIG. 30, respectively. The square part 7A has, at one corner thereof, four small triangular portions 701, 702, 703 and 704 cut by three cut lines b8, b9 and b10 and folded by a round folding line a11. This square part 7A and rectangular part 7B are assembled in a manner as shown in (C) of FIG. 30 to form one inner corner cover 7.

Figure 26:
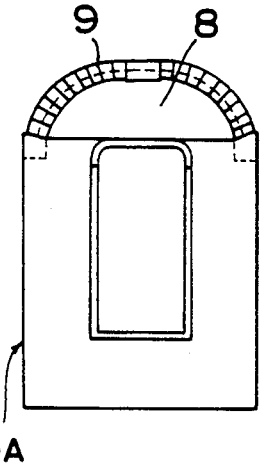
Figure 36:
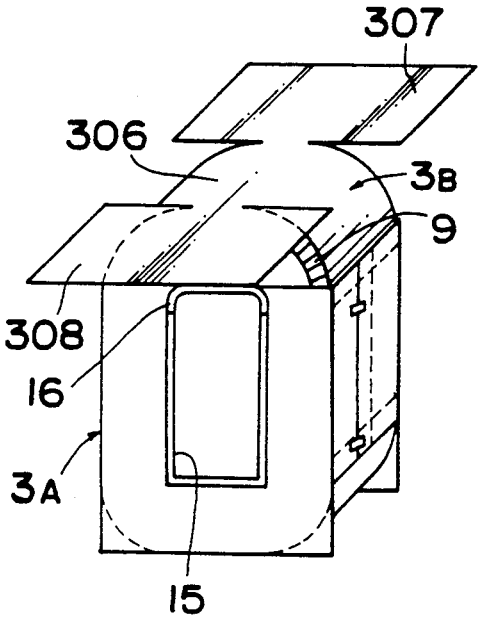
FIGS. 32, 33, 34, 35, 36 and 37 are views showing steps for mounting partial covers and the first and second main covers successively.
Figure 37:
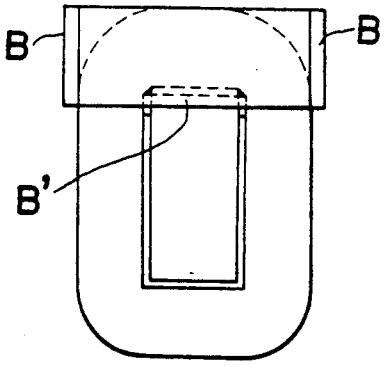
Figure 31:
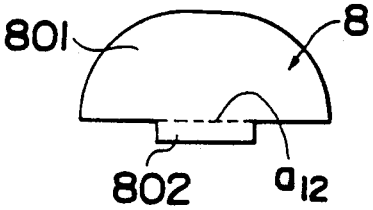

The partial cover 8 shown in FIG. 26 is a cover similar to the side partial cover 5 shown in FIGS. 23 and 28 which covers the side plane of the top yoke. As shown in FIG. 31, this side partial cover 8 has a main part 801 and a folded part 802 along a folding line a12.

Next, a mounting method of covers is explained.

As shown in FIG. 22, the cover mounting is performed in a state wherein the abutted joint section A of the top yoke 1*b* of the core is clamped by a clamping tool 13. The clamping tool 13 is comprised of an inner clamping plate 13A having a round upper surface to be fitted inside of the top yoke 1*b* and an outer clamping plate 13B to be put on the outer periphery of the top yoke 1*b*. The top yoke 1*b* is clamped between the inner and outer plates 13A and 13B by fastening each bolt 13C on the inner clamping plate 13A with a nut 13P.

At first, each edge cover 4 is mounted on each outer edge of the bottom yoke 1*a*. Both ends of the cover 4 are bonded or adhered to the core using an adhesive tape 11 or the like.

Next, the partial side cover 5 is mounted on the side plane of the bottom yoke as shown in FIG. 23 and, then, each inner corner cover 6 is mounted on each inner corner of the bottom yoke.

Overlapped portions between two partial covers 5 and 6 are adhered with each other using a suitable adhesive agent.

Figure 32:
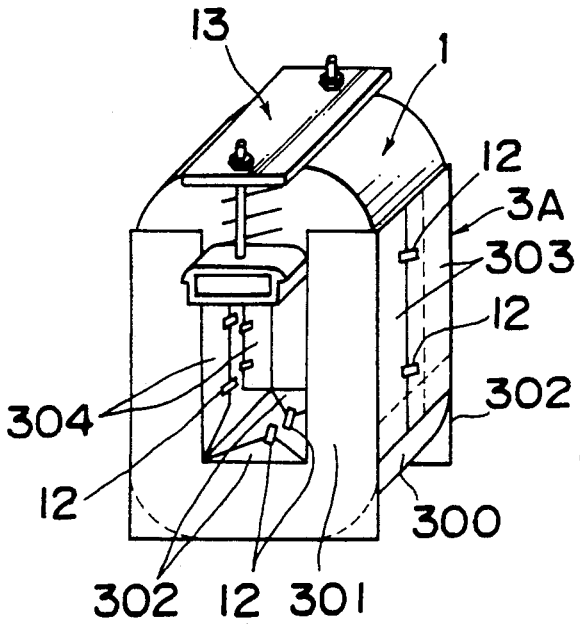
Figure 33:
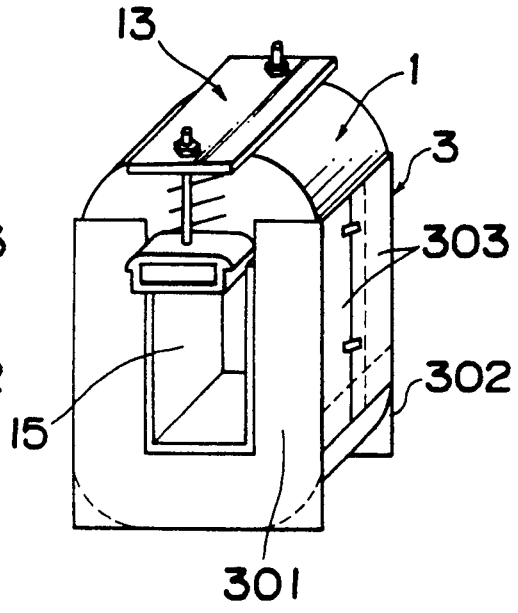
Figure 34:
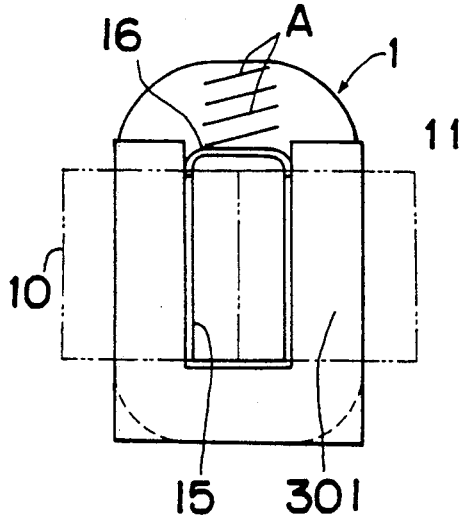
Figure 35:
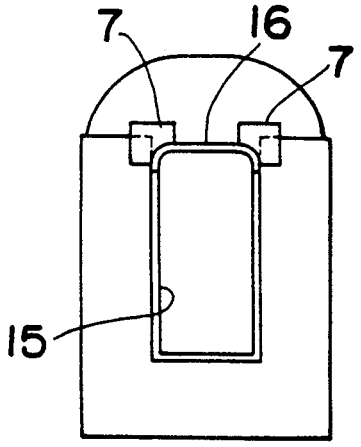

Then, as shown in FIG. 32, the first cover 3A of the core cover 3 is mounted so as to cover the two leg portions 1*c* and 1*d* and the bottom yoke 1*a* of the core 1. Each folded portion is adhered to the core or the overlapped portion using an adhesive tape 12. When the first cover 3A is completely set, a frame 15 of U-shape is inserted to the inside of the core, as shown in FIG. 33 and, thereafter, the clamping tool 13 is detached, as shown in FIG. 34, and a frame 16 is inserted to the inside of the top yoke so as to form a support frame for supporting the core from inside together with the frame 15.

The cover mounting operation is completed once to assemble windings to the core when the first cover 3A is mounted thereon.

In other words, the second cover 3B is not mounted on in this stage since it is necessary to assemble windings to the core in the next stage.

V. Assembling windings to the core

Figure 38:
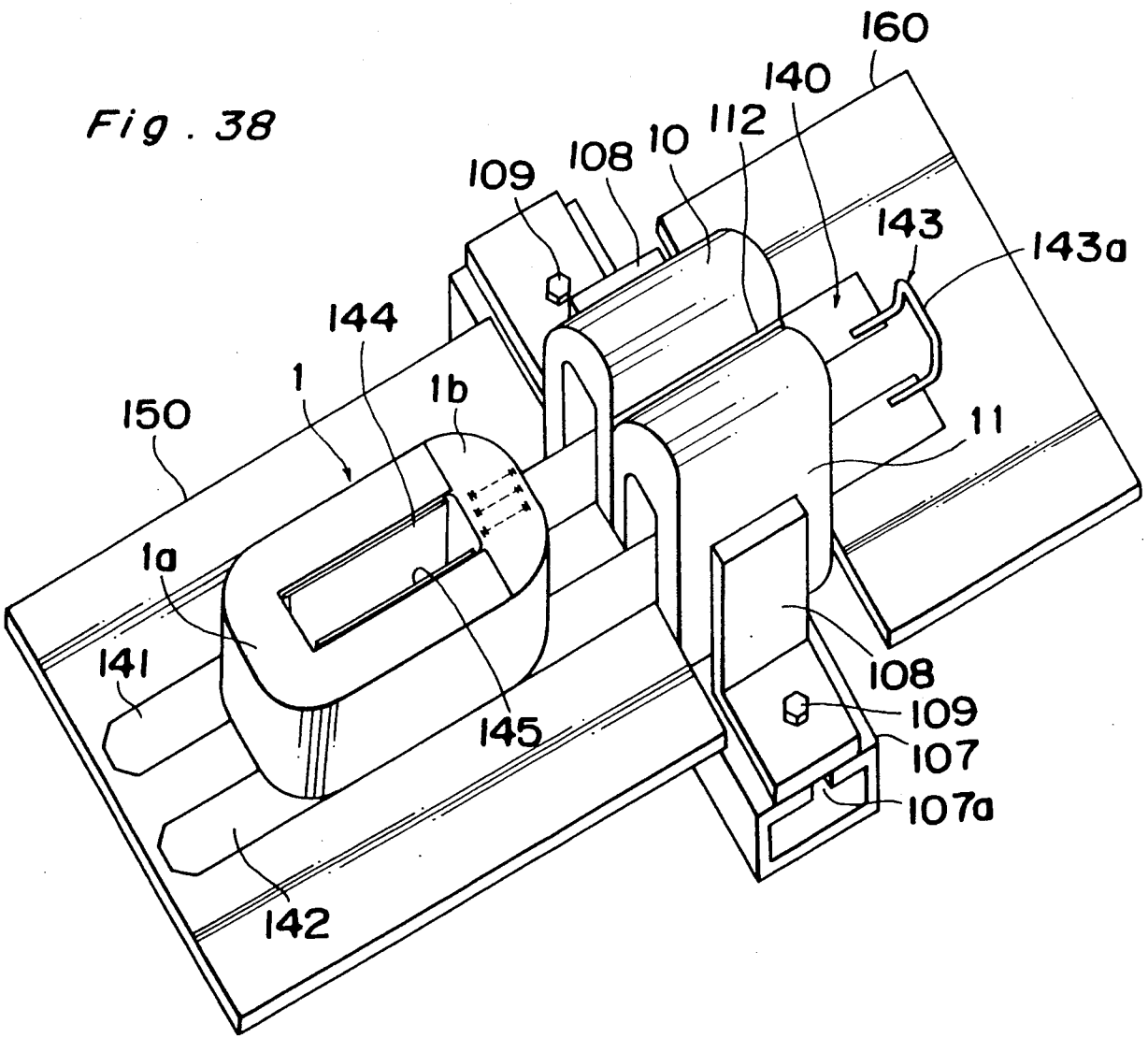
FIG. 38 is a perspective view of an assembly apparatus according to the present invention.

FIG. 38 shows an apparatus for assembling windings 10 and 11 to the core 1 having been covered by the first cover 3A, as explained in the foregoing process IV.

The apparatus is comprised of two horizontal working tables 150 and 160, a stand 107 for setting windings 10 and 11 and a sliding tool 140.

Both working tables 150 and 160 are respectively supported by a suitable lifting mechanism (not shown) so as to adjust the height thereof relative to the winding stand 107. The winding stand 107 arranged between two working tables 150 and 160 has a pair of L-shape press tools 108 for holding a pair of windings 10 and 11 in a standing posture therebetween.

Each press tool 108 is slidable along a slot 107*a* formed on the winding stand 107 and is fixed by fastening each bolt 109 at a desired position.

Figure 39:
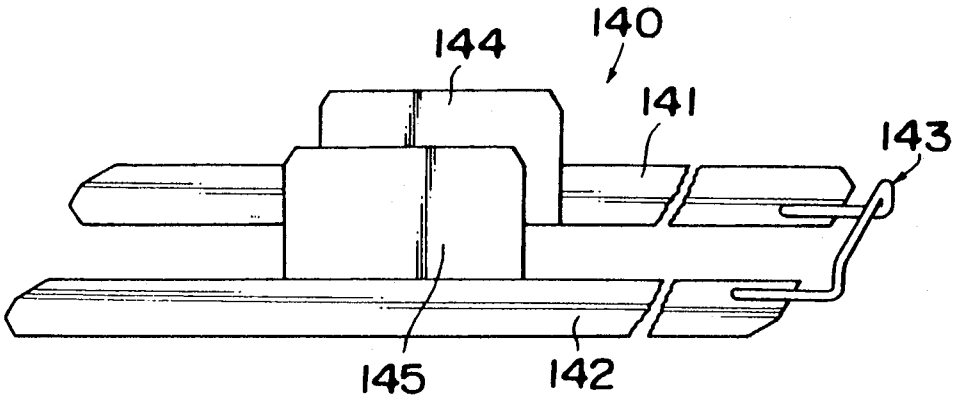
FIG. 39 is a perspective view of a sliding tool used in the assembly apparatus shown in FIG. 38, FIGS. 40, 41, 42, 43 and 44 are plan views showing respective assembling stages using the assembly apparatus shown in FIG. 38, respectively.

As shown in FIG. 39, the sliding tool 140 is essentially comprised of a pair of elongated sliding plates 141 and 142 extending in parallel with each other which are connected by a handle 143 at the respective ends thereof. These sliding plates 141 and 142 are arranged to have a distance nearly equal to the width of the window of the core 1 and a pair of rectangular press plates 144 and 145 are erected upwardly from inner edges of the sliding plates 141 and 142 so as to oppose to each other.

Each of the sliding plates 141 and 142 has a width slightly smaller than the width of the window of each winding 10 or 11 so as to be able to slidably insert the sliding plate in the window of the winding. The press plates 144 and 145 are formed so as to fit into the window of the core and, when the joint section of the core is opened to assemble the windings 10 and 11, hold the opened joint section from inside.

Next, an assembling operation using the assembling apparatus is explained referring to FIGS. 40 to 44.

Figure 40:
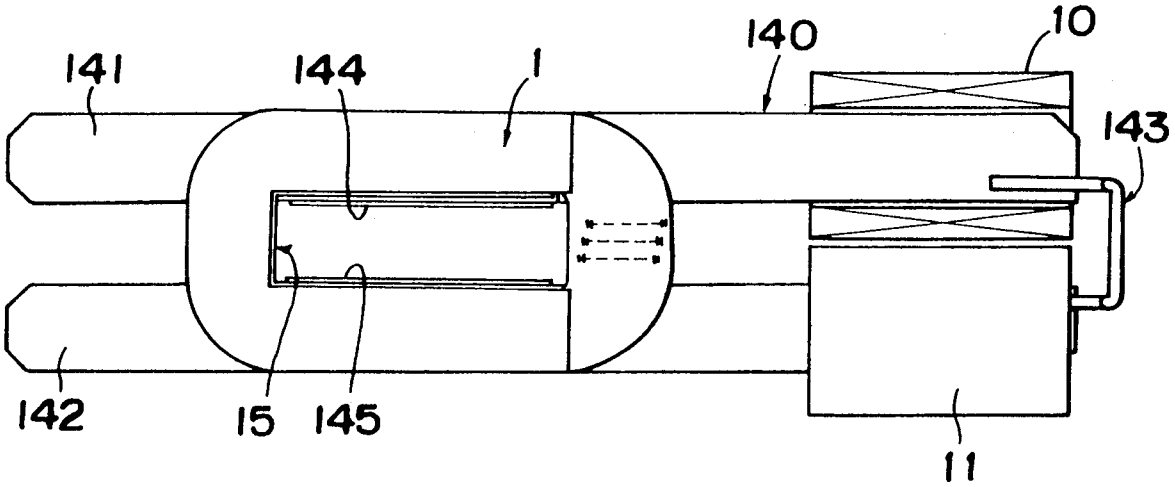
Figure 41:
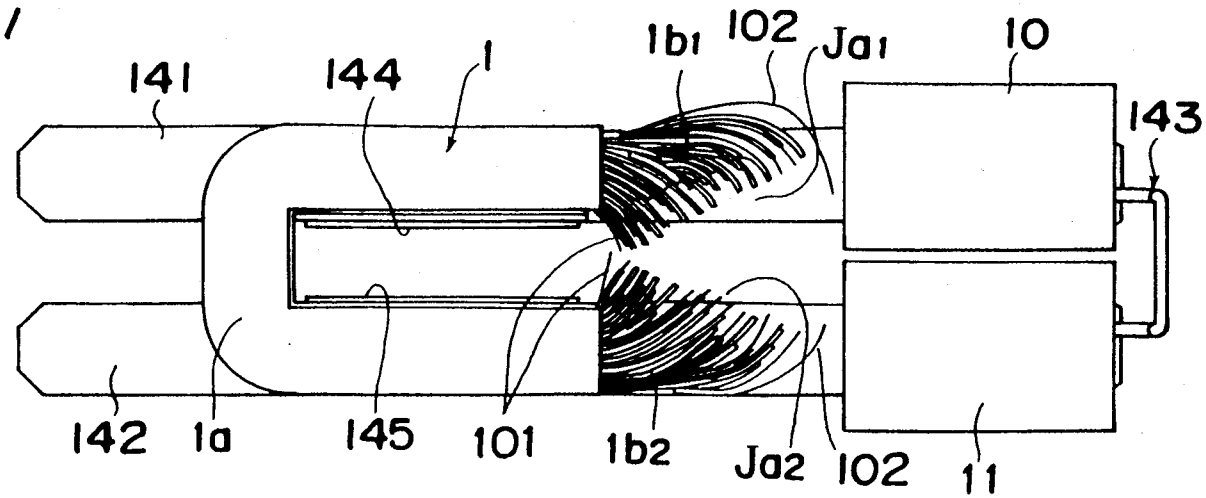

After setting the core 1 on the sliding tool 140 inserted through windows 10*a* and 11*a* of the windings as shown in FIG. 40, the joint section of the top yoke 1*b* is opened as shown in FIG. 41. As stated in the shaping process, the inner and outer protection sheets 101 and 102 made of a stainless steel are provided for protecting the inner and outer peripheries of the core 1.

Figure 42:
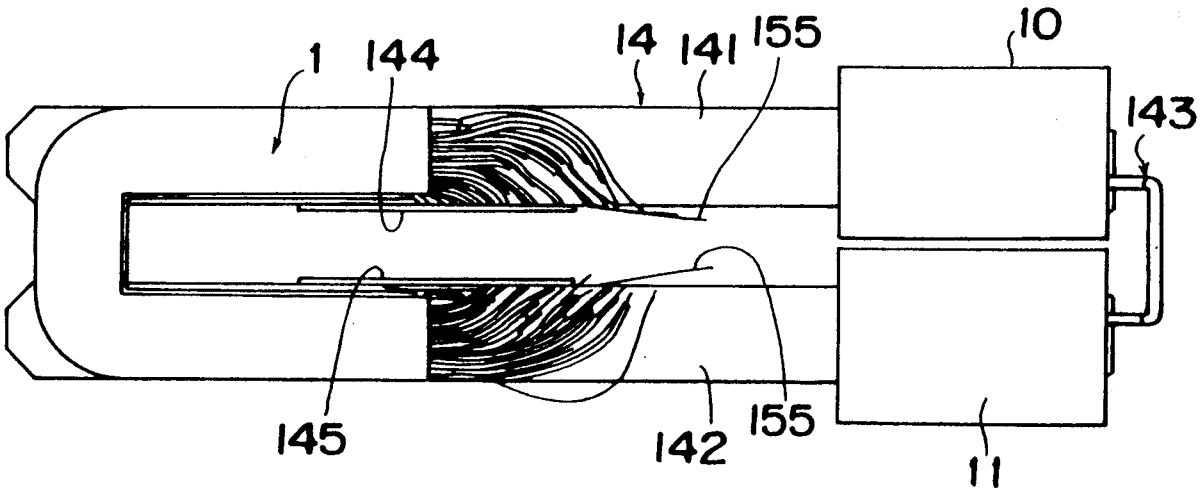

Then, the core 1 is slided on the sliding plates 141 and 142 relative to the press plates 144 and 145 to hold the separated top yoke portions 1*b*1 and 1*b*2 thereby from inside, as shown in FIG. 42. Upon moving the core 1, it is desirable to insert guide strips 155 between each press plate 144 or 145 and the separated top yoke portion 1*b*1 or 1*b*2 in order to prevent the separated top yoke portions 1*b*1 and 1*b*2 from breaking.

Figure 43:
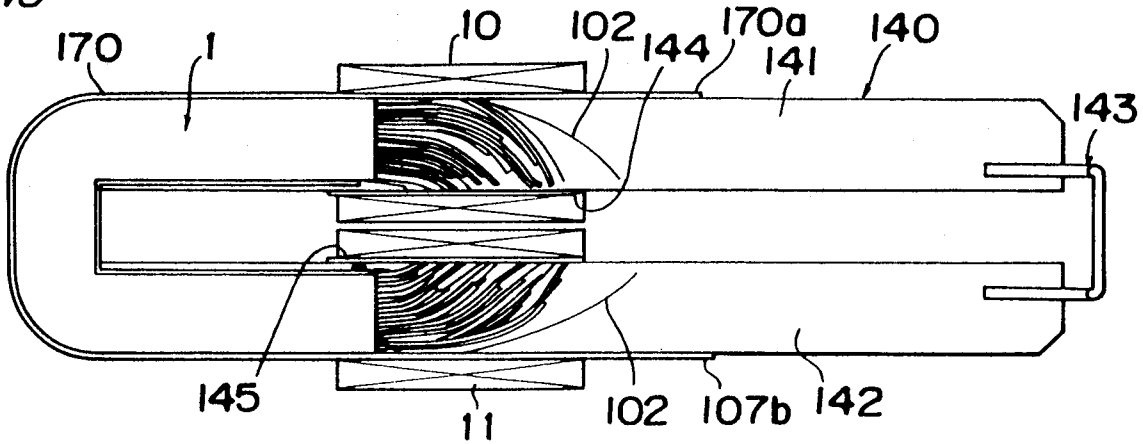

Next, a sliding band 170 made of a flexible resin or resin fibre material having an excellent slidability is set so as to surround the outer periphery of the core 1 after removing the guide strips 155, as shown in FIG. 43. It is important to inset each of ends 170*a* and 170*b* of the sliding band 170 into each of the windows 10*a* and 11*a* of the windings 10 and 11.

After these preparations, the core 1 is moved toward the windings 10 and 11 by pulling the sliding tool 140 and the leg portions 1*c* and 1*d* of the core 1 are inserted into respective windows 10*a* and 11*a* of the windings 10 and 11.

Figure 44:
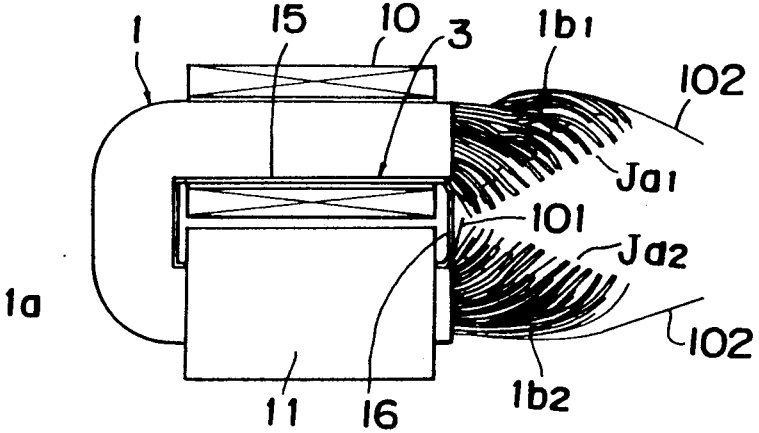

When the leg portions 1*c* and 1*d* of the core 1 are completely inserted into respective windows 10*a* and 11*a* of the windings 10 and 11, the sliding tool 140 is pulled out and the sliding band 170 is removed, as shown in FIG. 44.

Then, the separated yoke portions 1*b*1 and 1*b*2 are again jointed according to the overlapping or abutting joint method.

VI. Top cover mounting

Returning to FIG. 34, it shows the state after the assembling process V.

Top cover mounting operation is done in the order of FIG. 35, FIG. 25, FIG. 26, FIG. 36 and FIG. 37. Namely, inner corner covers 7, side partial covers 8, edge covers 9 and the second cover 3B are mounted on the top yoke 1*b*.

By cutting off unnecessary portions Band B' of the second cover 3B, the mounting of the core cover 3 is finished (See FIG. 19).

VII. Setting grounding element

Figure 45:
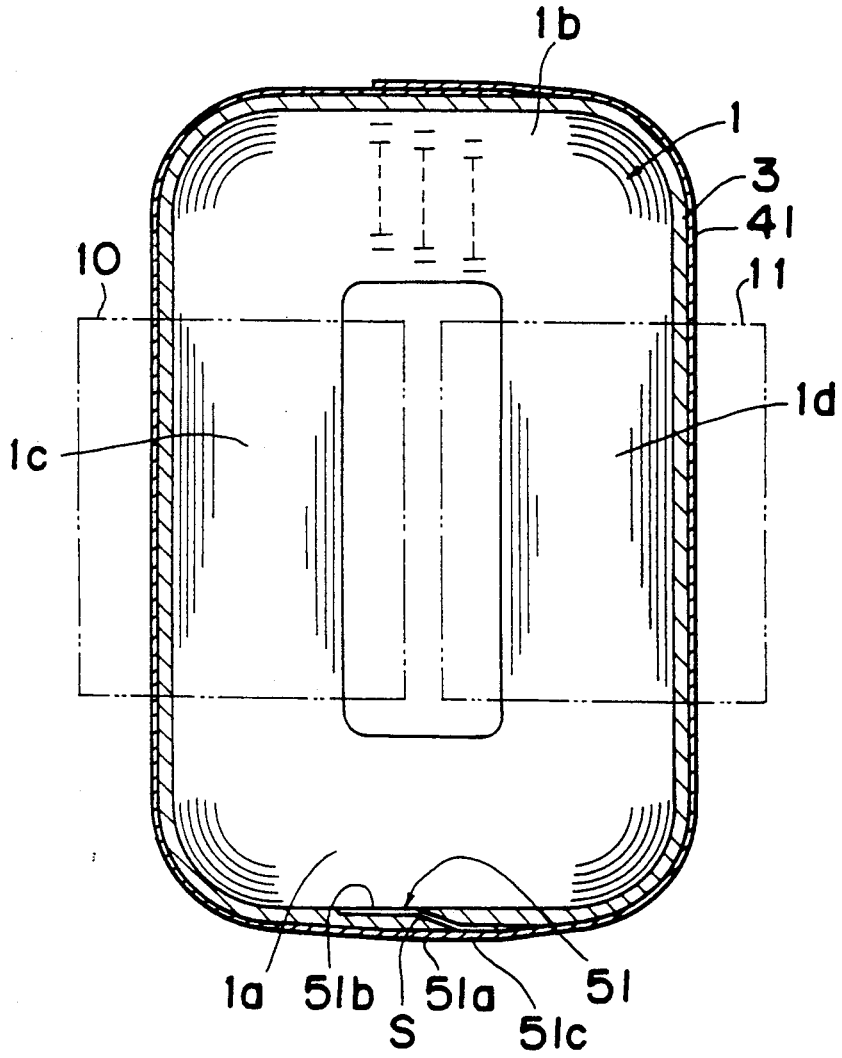
FIG. 45 is a cross-sectional view of a core for showing a grounding member.

As shown in FIG. 45, it is desirable to wind a protection band 41 made of a conductive material such as a silicon-steel around the core 1 covered by the core cover 3.

Figure 46:
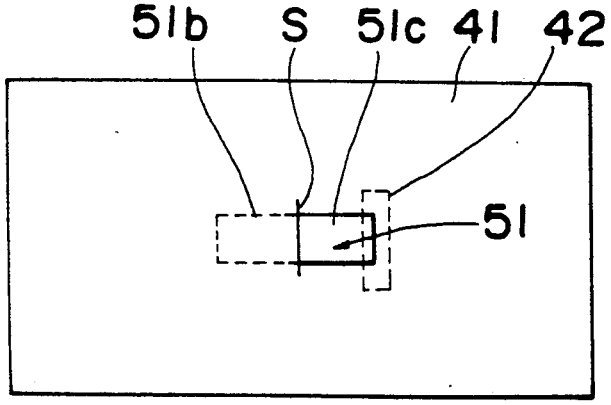
FIG. 46 is a bottom view of the core shown in FIG. 45

After winding the protection band 41, a grounding element 51 made of a conductive material such as copper is inserted to ground the core 1. In order for that, there is provided slits S with respect to the bottom center of the core cover 3 and corresponding position of the protection band 41. After insertion of the grounding element 51, the outer end thereof is bonded onto the protection band 51 by an adhesive tape 42 as show in FIG. 46.

Thus, the inner end 51*b* of the grounding element 51 contacts to the core 1 and the outer end 51*c* thereof contacts to the protection band 41 and, thereby, the core 1 is securely grounded to the protection band 41.

Figure 47:
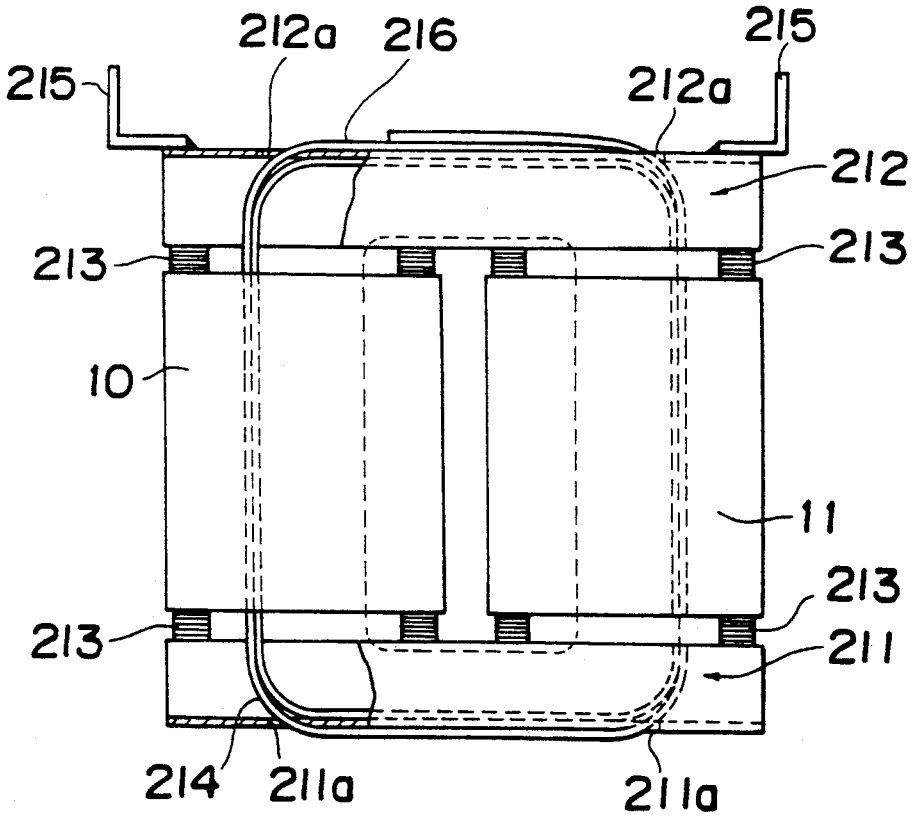
FIG. 47 is a front view of a transformer unit for showing a final assembly thereof.

FIG. 47 shows a final assembled unit as a main body of a transformer.

There are fitted bottom and top fastening members 211 and 212 each having a cross-section of U-shape to the bottom and top yokes of the core 1 to which the windings 10 and 11 have been assembled. Between each of the windings and each of the fastening members, there are inserted a pair of spacers 213.

After that, a fastening band 216 is inserted so as to be able to fasten the core between the bottom and top fastening members 211 and 212. Both ends of the fastening band 216 are overlapped and welded with each other.

Thereafter, mounting brackets 215 are provided for mounting the unit in a case (not shown) in which oil is filled.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fabrication method for transformers with an amorphous core, comprising the steps of:

(a) forming a ring-like lamination body by winding a thin strip of an amorphous magnetic alloy around a mandrel;

(b) cutting said lamination body off in a radial direction thereof using a grindstone cutter and a gas coolant to form a developed lamination body;

(c) shaping said developed lamination body into a core of a substantially rectangular configuration by jointing cut ends of said lamination body;

(d) magnetic-annealing said core;

(e) inserting leg portions of said core into windows of windings after opening a joint section thereof and thereafter, jointing the opened joint section again;

(f) covering said core as a whole with an insulation cover comprised of plural insulation cover parts, with each insulation cover part being shaped to fit the configuration of the part of the core it covers; and (g) mounting a ground plate of a conductive material on said insulation cover to ground said core covered by said insulation cover.

2. The fabrication method as claimed in claim 1, in which a portion of the ring-like lamination body formed in step (a) is clamped between a pair of holding plates in a direction of the thickness thereof at two positions on the holding plates, and the clamped portion thereof is cut by said grindstone cutter together with said pair of holding plates.

3. The fabrication method as claimed in claim 1, in which said developed lamination body is supported by a shaping mandrel at the center portion of a shorter side thereof, and is shaped along said shaping mandrel in a reversed U configuration by the weight of wing portions thereof not supported by said shaping mandrel.

4. The fabrication method as claimed in claim 3, in which said developed lamination body is rearranged so as to form a plurality of lamination blocks, each of which comprises a predetermined number of unit laminations shifted by a predetermined distance in a length wise direction with respect to each other, with each unit lamination comprising a predetermined number of lamination strips.

5. The fabrication method as claimed in claim 1, in which said leg portions of said core opened at the joint section are put on a pair of sliding plates which are inserted through windows of windings to be assembled with said core and are inserted into the corresponding windows of the windings by pulling said pair of sliding plates relatively to said windings.

6. The fabrication method as claimed in claim 1, in which said insulation cover comprises a first cover for covering said core except for the yoke thereof including the joint section, and a second cover for covering said yoke including the joint section, said first cover is mounted on said core before executing step (e), and said second cover is mounted on said remaining yoke after completion of step (e).

* * * * *